US005661857A

United States Patent [19]

McLean

[11] Patent Number: 5,661,857

[45] Date of Patent: Sep. 2, 1997

[54] WASH BASIN REPAIR BY A MOLDED INSERT

[76] Inventor: Vernon Walter McLean, Box 950, Estevan, Saskatchewan, Canada, S4A 2A7

[21] Appl. No.: 509,342

[22] Filed: Jul. 31, 1995

[51] Int. Cl.[6] ..... A47K 1/06

[52] U.S. Cl. ..... 4/657; 4/641; 4/580; 4/DIG. 18

[58] Field of Search ..... 4/641, 657, 658, 4/580, DIG. 18

[56] References Cited

U.S. PATENT DOCUMENTS

| | | | |
|---|---|---|---|
| 2,635,253 | 4/1953 | Kirvay | 4/658 |
| 3,045,254 | 7/1962 | Cook et al. | 4/580 |
| 3,614,793 | 10/1971 | Nemiroff | 4/580 |
| 4,267,609 | 5/1981 | Altman et al. | 4/580 |
| 4,602,393 | 7/1986 | Fiveash | 4/580 |

FOREIGN PATENT DOCUMENTS 2671307 7/1992 France .

*Primary Examiner*—Charles E. Phillips

*Attorney, Agent, or Firm*—Adrian D. Battison; Murray E. Thrift

[57] ABSTRACT

An insert is provided for a wash basin in which the insert is previously molded from a sheet of plastic material so as to cover the inner section of the bowl and a part of the upper surface of the top wall surrounding the bowl. The insert has a drain opening aligned with the drain opening of the bowl and an overflow opening aligned with the overflow opening of the bowl. A drain fitting the connection to a drain line has a pipe extending from the drain opening of the insert into the drain opening of the bowl and a flange at the top of the pipe engaging an upper surface of the insert. An overflow fitting has a pipe portion extending through the overflow opening of the insert opening of the bowl with a flange inside the insert. The pipe portion has a length that it projects through the overflow opening of the bowl to an area just behind the outer surface of the bowl and a strip of flexible material of L-shaped to cross section which is bent around the overflow opening.

13 Claims, 2 Drawing Sheets

WASH BASIN REPAIR BY A MOLDED INSERT

BACKGROUND OF THE INVENTION

This invention relates to a wash basin and to a technique for repairing a damaged or worn wash basin by mounting in the wash basin a molded insert.

In commercial situations, particularly hotels there are large numbers of wash basins. In order for the hotel to maintain its rating, it is highly important that the wash basin and other plumbing fittings be maintained in a clean, attractive and hygienic condition. Two types of wash basin have been commonly installed in past years both of which tend to become damaged or worn thus detracting from the acceptability of the plumbing fittings in the hotel.

Sinks or wash basins of cultured marble have been used for many years and are formed from a sheet of the cultured marble which is shaped to define an integral top surface and a basin or bowl recessed into the top surface. The cultured marble has the problem that the differential expansion caused by the running of hot water into the bowl tends to cause fine cracking in the surface leading to discoloration and the possibility of growth of bacteria and molds in the cracks leading to an un-hygienic condition.

Another type of basin which has been used widely is that of the enamel coated steel in which the bowl is formed with a surrounding flange which sits in a work surface of a separate material. The enamel type sink has the disadvantage that the enamel can be chipped away leading to unsightly spots which again can become un-hygienic.

It is important therefore to provide a technique for repair of such wash basins which avoids the necessity for costly replacement.

French patent Application 2671307 of Ciliento published 10 Jul. 1992 discloses a technique for molding a liner into a bath tub in situ to define a new internal surface for the tub. However this appears to be an impractical arrangement which has achieved little commercial success.

SUMMARY OF THE INVENTION

According to one aspect of the invention there is provided a wash basin comprising a horizontal top wall having an upper surface, a bowl recessed from the top wall so as to depend downwardly therefrom and to define a concave inner surface for receiving and containing washing water, a drain opening at a bottom of the bowl, an overflow opening in the bowl located below the top wall and above the bottom, a separate insert previously molded of a sheet of plastics material covering the inner surface of the bowl and a part of the upper surface of the top wall surrounding the bowl, the insert having a drain opening aligned with the drain opening of the bowl and an overflow opening aligned with the overflow opening of the bowl, a drain fitting for connection to a drain line having a pipe extending through the drain opening of the insert and through the drain opening of the bowl and a flange at the top of the pipe engaging an upper surface of the insert surrounding the drain opening of the insert and an overflow fitting having a pipe portion extending through the overflow opening of the insert and through the overflow opening of the bowl.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
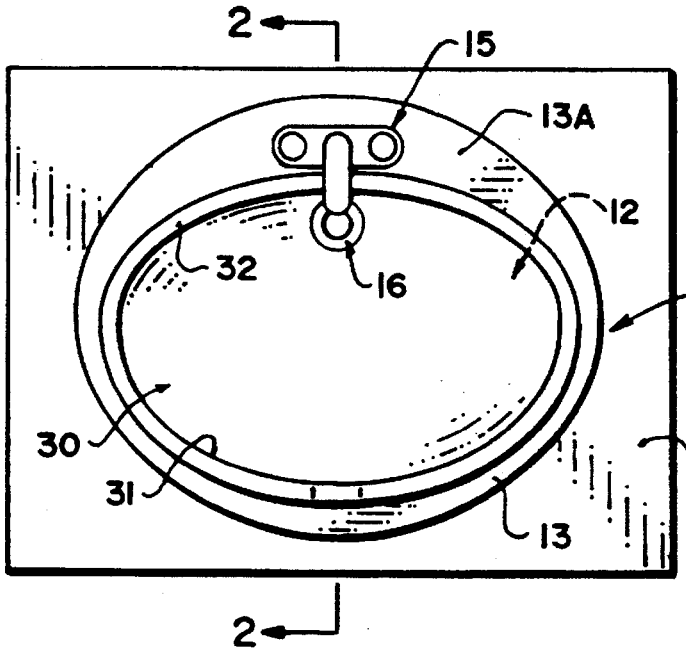
FIG. 1 is a top plan view of a first embodiment of wash basin according to the present invention.

Two embodiments are shown in the drawings of a repaired wash basin construction. The first embodiment shown in FIGS. 1 and 2 includes a wash basin of the enameled steel type generally indicated at 10 mounted within a work top 11. The enameled steel defines a bowl generally indicated at 12 and a surrounding flange 13, the flange having a downturned lip 14 at its outer edge which engages a top surface of the work surface 11. The flange 13 is of increased width at a rear 13A of the bowl for receiving the conventional faucet assembly 15. An opening 13B through the flange 13 allows the faucet assembly 15 to be mounted on the flange 13 with water pips 15A projecting through the opening 13B.

The sink 10 further includes a drain assembly 16 including a drain pipe 17 connecting to a drain line 19 for discharge of washing water to the drainage system. Around the top of the pipe 17 is provided a flange 18 which lies horizontal so as to support the pipe in vertical orientation for discharge of the water through the bottom of the bowl. A clamp 20 engages on the pipe 17 to squeeze against the flange 18. The bowl further includes an overflow opening 21 communicating with an overflow pipe 22 on the outside of the bowl with that pipe communicating to the drainage system 19.

Figure 3:
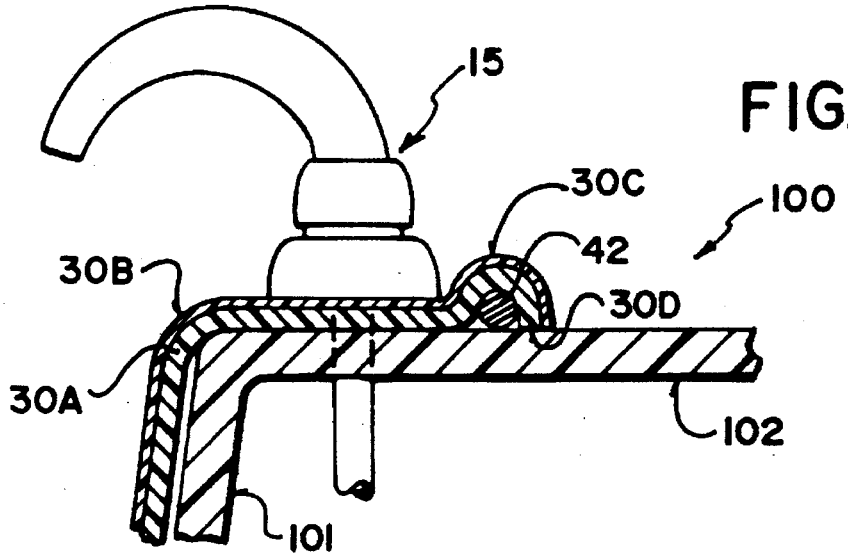
FIG. 3 is a cross sectional view similar to that of FIG. 2 showing a part only of the wash basin and showing a separate embodiment.
Figure 5:
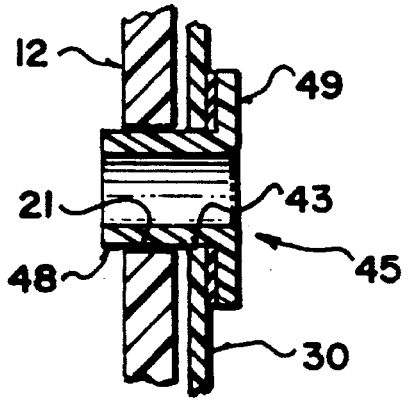
FIG. 5 is a cross sectional view along the lines 5—5 of FIG. 4.

The second embodiment is shown only in part in FIGS. 3 and 5 and comprises a combined work surface and bowl structure generally indicated at 100 with the bowl section 101 being integrally formed with the work top section 102 from a suitable molded material such as cultured marble. The bowl of course includes the conventional plumbing arrangements including the faucet assembly, drain assembly and overflow as described above.

It will of course be appreciated that the enamel steel bowl and the cultured marble type bowl are both conventional and widely used. The arrangement of the present invention is in addition not limited to the use of these particular types of wash basin and other wash basins can be modified in accordance with the construction as described hereinafter. The existing wash basin as described above is therefore repaired by the addition of an insert 30 mounted on the inside of the bowl 12. The insert is separately and previously molded from a mold shaped to follow the intended sink and includes a bowl portion 31 and a flange portion 32. The bowl portion 31 closely follows the shape of the inside surface of the bowl 12. In the embodiment shown in FIGS. 1 and 2, the flange portion 32 just engages over the lip of the bowl to form a narrow band surrounding the top of the bowl of insufficient width to reach the faucet assembly 15.

In practice the bowl portion 31 when molded is slightly smaller than the inside surface of the bowl 12 so that a space therebetween can be filled with silicone sealant material 33 or with thin foamed packaging material 34.

The insert is formed from a thin sheet of plastics material which is vacuum formed from a flat sheet to define the required shape in a conventional molding process. The sheet of plastics material includes a lower layer 30A of ABS material and an outer layer 30D of acrylic, the acrylic layer providing the wear resistant coating and having the required attractive appearance of the required color to match the existing sink construction. This provides an insert which is relatively stiff and is effectively self-supporting.

In the molding process, an edge of the insert is molded so as to include an arched section 30C with the outermost edge of the sheet being turned downwardly so that an edge 30D of that sheet lies parallel to the upper surface of the sink and substantially in contact with that upper surface. In order to form the arched section 30C, the material is bent upwardly from its initial horizontal extent.

In the arrangement of FIG. 3, the width of the flange is increased so that it includes the area for the faucet assembly 15. In this arrangement the flange section of the insert also has an opening aligned with the opening in the work surface to accommodate the mounting pipes of the faucet assembly.

In general, therefore, the insert is molded so that it matches the shape of the existing bowl. This can in some cases includes soap dish formations within the bottom of the bowl area, in which case the insert would be molded to include these soap dish formations.

It is also possible that such soap dish formations can be molded into the insert where they are not provided in the bowl itself. Since it will be appreciated that it is necessary for the insert to match the bowl only at the flange as the bowl section turns into the horizontal flange section and at the drain opening and the overflow.

Figure 2:
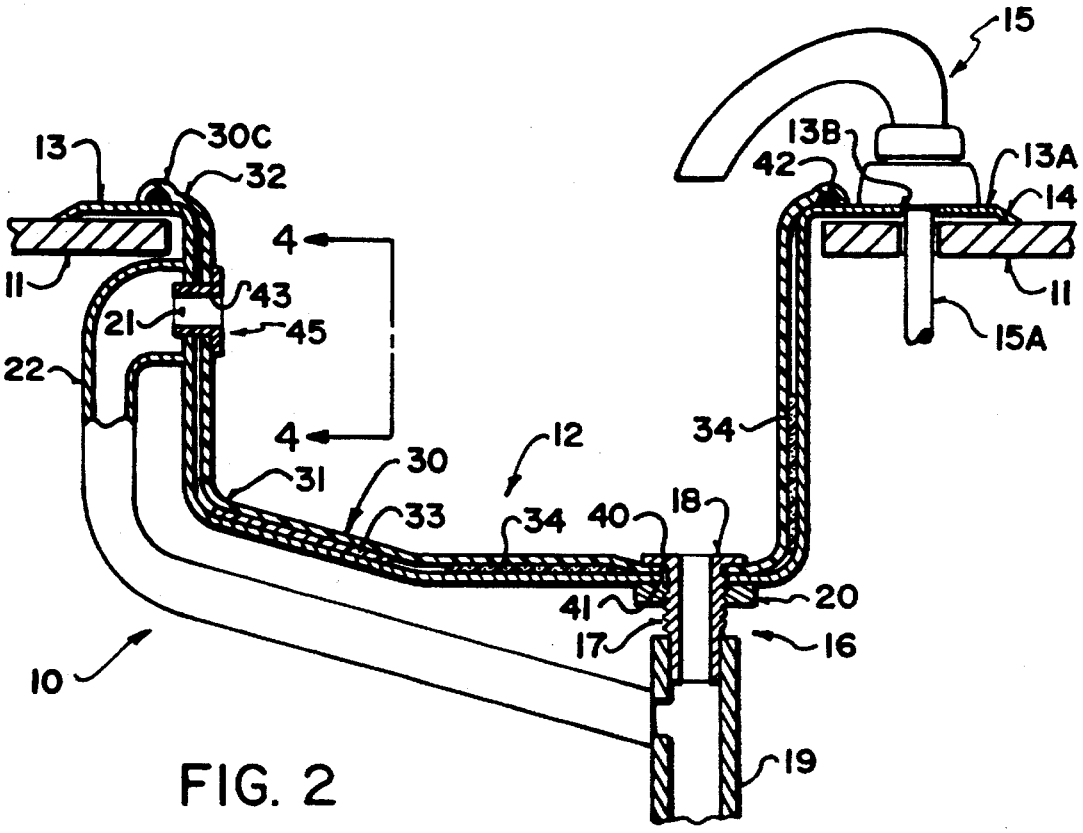
FIG. 2 is a cross sectional view along the lines 2—2 of FIG. 1 on an enlarged scale.

Turning therefore to FIG. 2, the insert includes a drain opening 40 directly aligned with an overlying the drain opening 41 of the bowl 12. The flange 18 and the clamp 20 are thus disassembled from the existing bowl prior to the insertion of the insert 30. After the insert is in place, the flange 18 on the pipe 17 is returned to its initial position and the clamping arrangement 20 is replaced to a clamping action thus squeezing the insert onto the bowl at the overlying openings 40, 41.

Before insertion of the insert into the bowl, the arch 30C is filled with a sealant material 42 of silicone or the like which is then pressed into engagement with the upper surface of the flange of the bowl to provide a sealing action there against. The shape of the arch 30C and the edge 30D is arranged so that the acrylic material is presented at the edge so that neither the inside ABS nor the silicone itself are exposed at the junction between the insert and the flange of the bowl.

Figure 4:
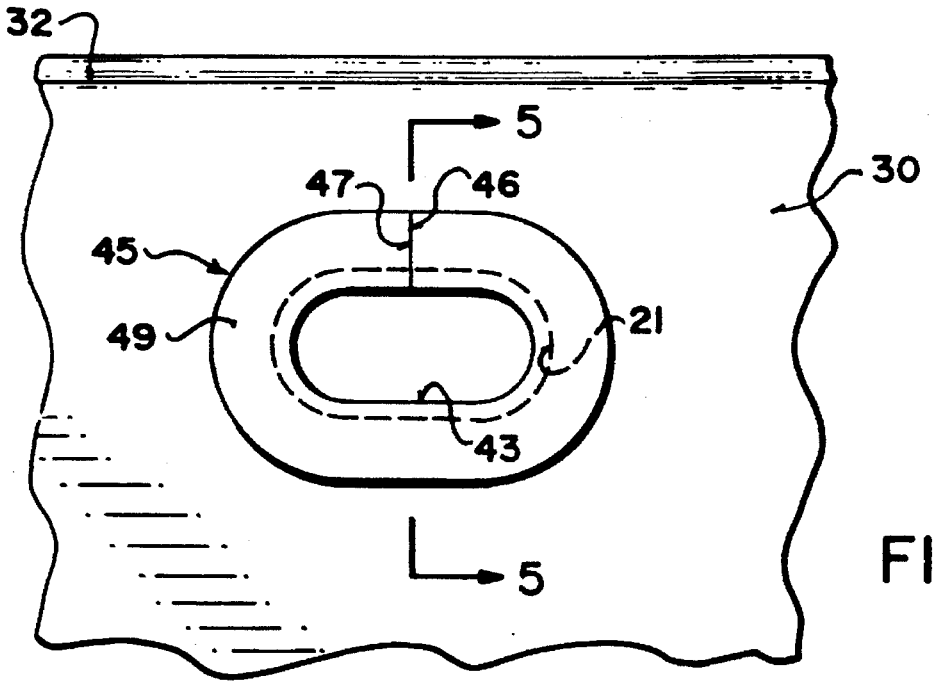
FIG. 4 is a view along the lines 4—4 of FIG. 2 on an enlarged scale.

At the overflow opening 21 of the bowl, the insert is initially closed without any opening being formed in that area. Once the insert is in place and fixed into position by the sealant and the drain assembly, an opening is formed in the insert by firstly drilling a hole through the insert in the area of the opening 21 and then by using a router to cut an opening 43 in the insert which is identical in shape and location to the opening 21 in the bowl. When so formed, an overflow fitting 45 is located in place in the overlying openings. The overflow fitting is formed from a flexible strip of plastics material which is L-shaped cross section as shown in FIG. 5. The strip has two ends 46 and 47 and has a length equal to a circumference of the opening 43/21. The strip is sufficiently flexible so that it can be bent into shape as shown in FIG. 4 so that the leg of the L-shape forms a pipe portion 48 while the base of the L-shape forms a flange 49 surrounding the openings 21/43. This arrangement therefore provides a short pipe section which communicates the water from the inside of the bowl through to the outlet pipe 22 without the necessity for molding specifically shaped elements for defining the overflow fitting.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A wash basin comprising:

a horizontal top wall having an upper surface;

a bowl recessed from the top wall so as to depend downwardly therefrom and to define a concave inner surface for receiving and containing washing water;

a drain opening at a bottom of the bowl;

an overflow opening in the bowl located below the top wall and above the bottom;

a separate insert previously molded from a sheet of plastics material covering the inner surface of the bowl and a part of the upper surface of the top wall surrounding the bowl;

the insert having a drain opening aligned with the drain opening of the bowl and an overflow opening aligned with the overflow opening of the bowl;

a drain fitting for connection to a drain line having a pipe extending through the drain opening of the insert and through the drain opening of the bowl and a flange at the top of the pipe engaging an upper surface of the insert surrounding the drain opening of the insert;

and an overflow fitting formed from a strip of flexible material of L-shaped cross section which is cut to a length equal to the circumference of the overflow opening of the insert, is curved to follow the shape of the overflow opening and to define abutting ends of the strip, and is inserted into the overflow opening so as to define a pipe portion extending through the overflow opening of the insert and through the overflow opening of the bowl and a flange at an end of the pipe portion inside the insert.

2. The wash basin according to claim 1 wherein the pipe portion has a length so as to just project through the overflow opening of the insert and the overflow opening of the bowl to an area just behind an outer surface of the bowl.

3. The wash basin according to claim 1 wherein the abutting ends of the strip are arranged at a top of the overflow opening.

4. The wash basin according to claim 1 wherein the drain fitting includes clamp means for engaging a bottom surface of the bowl at the drain opening therein so as to clamp the insert and the bowl tightly together at the drain openings thereof.

5. The wash basin according to claim 1 wherein the insert is shaped such that a peripheral edge thereof lies wholly on the upper surface of the horizontal top wall at a position thereon spaced outwardly from the bowl so as to surround the bowl.

6. The wash basin according to claim 1 wherein the insert is shaped around a full periphery thereof adjacent the peripheral edge thereof such that the sheet of plastics material is bent upwardly at a position adjacent to but spaced from an outermost edge surface of the sheet and forms an arch between the upward bend and the outermost edge surface, the outermost edge surface of the sheet lying substantially parallel to and in contact with the upper surface of the top wall.

7. The wash basin according to claim 6 including sealing material substantially filling an area under the arch so as to lie between the insert and the upper surface of the top wall.

8. The wash basin according to claim 1 wherein the sheet of plastics material comprises a layer of ABS plastics covered with an acrylic layer.

9. A wash basin comprising:

a horizontal top wall having an upper surface;

a bowl recessed from the top wall so as to depend downwardly therefrom and to define a concave inner surface for receiving and containing washing water;

a drain opening at a bottom of the bowl;

an overflow opening in the bowl located below the top wall and above the bottom;

a separate insert previously molded from a sheet of plastics material covering the inner surface of the bowl and a part of the upper surface of the top wall surrounding the bowl;

the insert having a drain opening aligned with the drain opening of the bowl and an overflow opening aligned with the overflow opening of the bowl;

a drain fitting for connection to a drain line having a pipe extending through the drain opening of the insert and through the drain opening of the bowl and a flange at the top of the pipe engaging an upper surface of the insert surrounding the drain opening of the insert;

an overflow fitting having a pipe portion extending through the overflow opening of the insert and through the overflow opening of the bowl;

the insert being shaped such that a peripheral edge thereof lies wholly on the upper surface of the horizontal top wall at a position thereon spaced outwardly from the bowl so as to surround the bowl;

the insert being shaped around a full periphery thereof adjacent the peripheral edge thereof such that the sheet of plastics material is bent upwardly at a position adjacent to but spaced from an outermost edge surface of the sheet and forms an arch between the upward bend and the outermost edge surface, the outermost edge surface of the sheet lying substantially parallel to and in contact with the upper surface of the top wall.

10. The wash basin according to claim 9 including sealing material substantially filling an area under the arch so as to lie between the insert and the upper surface of the top wall.

11. The wash basin according to claim 9 wherein the sheet of plastics material comprises a layer of ABS plastics covered with an acrylic layer.

12. A wash basin comprising:

a horizontal top wall having an upper surface;

a bowl recessed from the top wall so as to depend downwardly therefrom and to define a concave inner surface for receiving and containing washing water;

a drain opening at a bottom of the bowl;

an overflow opening in the bowl located below the top wall and above the bottom;

a separate insert previously molded from a sheet of plastics material covering the inner surface of the bowl and a part of the upper surface of the top wall surrounding the bowl;

the insert having a drain opening aligned with the drain opening of the bowl and an overflow opening aligned with the overflow opening of the bowl;

a drain fitting for connection to a drain line having a pipe extending through the drain opening of the insert and through the drain opening of the bowl and a flange at the top of the pipe engaging an upper surface of the insert surrounding the drain opening of the insert;

an overflow fitting having a pipe portion extending through the overflow opening of the insert and through the overflow opening of the bowl;

the insert being shaped adjacent a peripheral edge thereof such that the sheet of plastics material is bent upwardly at a position adjacent to but spaced from an outermost edge surface of the sheet and forms an arch between the upward bend and the outermost edge surface, the outermost edge surface of the sheet lying substantially parallel to and in contact with the upper surface of the top wall;

wherein there is provided a sealing material substantially filling an area under the arch so as to lie between the insert and the upper surface of the top wall.

13. The wash basin according to claim 12 wherein the sheet of plastics material comprises a layer of ABS plastics covered with an acrylic layer.

* * * * *